US005283990A

United States Patent [19]

Shank, Jr.

[11] Patent Number: 5,283,990

[45] Date of Patent: Feb. 8, 1994

[54] BLAST NOZZLE WITH INLET FLOW STRAIGHTENER

[75] Inventor: James D. Shank, Jr., Vestal, N.Y.

[73] Assignee: Church & Dwight Co., Inc., Princeton, N.J.

[21] Appl. No.: 979,301

[22] Filed: Nov. 20, 1992

[51] Int. Cl.[5] ..... B24C 5/04; B24C 7/00

[52] U.S. Cl. ..... 51/427; 51/439; 51/429; 51/436; 239/592; 239/597

[58] Field of Search ..... 51/439, 427, 429, 319, 51/320, 410; 239/589, 592, 597

[56] References Cited

U.S. PATENT DOCUMENTS

| | | | |
|---|---|---|---|
| 561,483 | 6/1896 | Bryce | 51/439 |
| 1,410,117 | 3/1922 | Pool | 51/439 |
| 1,848,122 | 3/1932 | Forster | 51/439 |
| 1,940,972 | 12/1933 | Schwartzkopf | 51/427 |
| 2,605,596 | 8/1952 | Uhri | 51/439 |
| 3,032,930 | 5/1962 | Williams | 51/439 |
| 3,139,705 | 7/1964 | Histed | 51/439 |
| 3,543,444 | 12/1970 | Mehta | 51/427 |
| 3,628,627 | 12/1971 | Arnold | 51/439 |
| 4,022,385 | 5/1977 | Krueger | 239/592 |
| 4,817,342 | 4/1989 | Martin et al. | 51/439 |
| 4,947,589 | 8/1990 | Zwicker | 51/439 |
| 5,050,805 | 9/1991 | Lloyd et al. | 239/597 |
| 5,123,206 | 6/1992 | Woodson | 51/320 |

FOREIGN PATENT DOCUMENTS

| | | | |
|---|---|---|---|
| 90691 | 10/1983 | European Pat. Off. | 51/439 |
| 506289 | 8/1920 | France | 239/592 |
| 3-5976 | 2/1991 | Japan | 51/439 |
| 2191127 | 12/1987 | United Kingdom | 51/439 |

*Primary Examiner*—Bruce M. Kisliuk
*Assistant Examiner*—Bryan Reichenbach
*Attorney, Agent, or Firm*—Charles B. Barris

[57] ABSTRACT

A blast nozzle apparatus for directing abrasive particles against a surface to remove therefrom adherent materials includes a flow straightener intermediate the blast nozzle and flexible supply hose so as to rehomogenize the abrasive particles throughout the total area of the blast nozzle inlet and counteract the nonuniform concentrating effect on the blast media as the abrasive particles are being carried through the bends and turns of the flexible supply hose. The flow straightener includes a rigid longitudinal bore between the supply hose and blast nozzle inlet.

11 Claims, 1 Drawing Sheet

BLAST NOZZLE WITH INLET FLOW STRAIGHTENER

BACKGROUND OF THE INVENTION

1. Field of the Invention

The present invention relates generally to blast nozzles used to remove adherent material, such as paint, scale, dirt, grease and the like from solid surfaces with abrasive particles propelled by air. In particular, the present invention is directed to an improved blast nozzle apparatus which provides a uniform flow of air and blast media to the inlet of the blast nozzle and consequently produces a uniform flow of blast media from the nozzle outlet.

2. Description of the Prior Art

In order to clean a solid surface so that such surface can again be coated such as, for example, to preserve metal against deterioration, or simply to degrease a solid surface such as surfaces contacting food or building structures which contain food serving or food processing operations, it has become common practice to use an abrasive blasting technique wherein abrasive particles are propelled by a high pressure fluid against the solid surface in order to dislodge previously applied coatings, scale, dirt, grease or other contaminates. Various abrasive blasting techniques have been utilized to remove the coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or exterior of the nozzle at the targeted surface to be cleaned and such latter process, although primarily a dry blasting technique, is considered wet blasting inasmuch as media recovery and clean up is substantially different from that utilized in a purely dry blasting operation.

A typical dry blasting apparatus as well as a wet blasting apparatus which utilizes highly pressurized air to entrain, carry and direct the abrasive blast media to the solid surface to be treated and low pressure water for dust control comprises a dispensing portion in which the blast media typically contained in a storage tank is entrained in highly pressurized air, a flexible hose which carries the air/blast media mixture to the blast nozzle and which allows the operator to move the blast nozzle relative to the surface to be cleaned and the blast nozzle which accelerates the abrasive blast media and directs same into contact with the surface to be treated. Water may be added either internally in the blast nozzle and mixed with the air stream passing therethrough or a low pressure stream of water may be provided externally of the blast nozzle and directed at the surface to be treated so as to control dust. The blast nozzle is typically hand-held by the operator and moved relative to the targeted surface so as to direct the abrasive blast media across the entire surface to be treated.

The blast media or abrasive particles most widely used for blasting surfaces to remove adherent material therefrom is sand. Sand is a hard abrasive which is very useful in removing adherent materials such as paint, scale and other materials from hard metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other relatively soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to non-soluble blast media such as sand, in particular, for removing adherent coatings from relatively soft substrates such as softer metals as aluminum, composite surfaces, plastics, concrete and the like is sodium bicarbonate. While sodium bicarbonate is softer than sand, it is sufficiently hard to remove coatings from aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. However, sodium bicarbonate is also friable and its lighter weight relative to sand requires operating conditions and apparatus for blasting which may be quite different from the conditions and apparatus used to blast with sand.

In most any abrasive blasting operation, the flexible hose which transports the blast media and pressurized fluid stream from the dispensing device to the blast nozzle often bends at intermediate points and typically is draped over the shoulder of the operator. What has been found is that the flow of abrasive particles or blast media through the nozzle is not uniform inasmuch as the sharp bend formed as the hose travels over the shoulder of the operator results in centrifugal forces which tend to concentrate the blast media to the outside of the bend and, thus, in only one quadrant of the hose. Consequently, the abrasive blast media concentrates in only a portion of the inlet and outlet of the blast nozzle. The performance of the blasting operation is hindered inasmuch as the blast media is not uniform throughout the whole of the blast nozzle outlet causing a reduction of the "hot spot" which is the area of maximum contact of the blast media on the surface being treated at a given moment. A reduction in the hot spot translates directly to a reduction in productivity which can be defined as the volume of contaminant removed from the substrate per time and flow rate of blast media through the nozzle. There may also occur nonuniform erosion of the interior of the blast nozzle and the supply hose near the blast nozzle inlet in view of the concentrated abrasive flow. Erosion and wear within the blast nozzle may result in turbulent flow of the abrasive blast particles through the nozzle which reduces the velocity of the particles and consequently also reduces productivity.

Accordingly, it would be worthwhile to provide a uniform flow of the abrasive blast media into the inlet of the blast nozzle to prevent turbulent flow of the media particles and obtain maximum velocity of media from the nozzle outlet and, as well, provide uniform flow through the whole of the nozzle outlet to maximize the hot spot, thereby providing optimum production rates.

SUMMARY OF THE INVENTION

A primary objective of the present invention is to provide a new and improved blast nozzle for abrasive blasting in which the blast media is propelled to the surface by means of pressurized air and which achieves increased performance rates above prior art devices.

Another objective of the invention is to provide a blast nozzle which produces less turbulence as the blast media particles are accelerated therein thereby maintaining maximum velocity of blast media particles and maximum cleaning rate during operation.

The objects identified above as well as other features and advantages of the invention are achieved by providing a supply of blast media and compressed air, a flexible supply hose to receive and direct the mixture of blast media and pressurized air to the inlet of a blast nozzle and a blast nozzle having a passage formed therein along a straight longitudinal axis wherein the passage has a converging inlet end, an orifice and an expanding outlet end to accelerate the flow of air and abrasive blast media. Importantly, there is placed intermediate of the inlet of the blast nozzle and the flexible supply hose which transports the mixture of air and blast media from the dispensing device to the blast nozzle, a section of straight pipe which includes a bore having substantially the same diameter as the inlet end of the blast nozzle and which bore in the straight pipe defines a substantially straight path between the flexible hose and the inlet of the blast nozzle. This intermediate straight pipe section counteracts the centrifugal forces placed on the blast media as it traverses the flexible supply hose which often twists and bends from the dispensing device and, in particular, over the shoulder of the operator to the nozzle inlet, which centrifugal forces tend to concentrate the blast media into one small quadrant of the supply hose and the nozzle inlet with the nonuniform concentration being maintained at the blast nozzle outlet resulting in insufficient productivity. The intermediate straight pipe section must have a sufficient length to diameter ratio to rehomogenize the blast media into the air carrier and reestablish a uniform concentration of the blast media throughout the entire diameter of the blast nozzle inlet. It has been found that a length to diameter ratio of at least 6 is sufficient to disrupt the nonuniform concentration of flow and, again, provide for a uniform dispersement of the blast media throughout the diameter of the blast nozzle inlet. The performance rate of the blast nozzle is substantially improved as the abrasive blast media is now uniformly dispersed through the whole of the blast nozzle outlet. The blast nozzle apparatus with the intermediate flow straightening pipe has been found most useful in blasting with very friable blast media such as sodium bicarbonate and, as well, has been shown to be advantageous with various configurations of blast nozzle apparatus.

DETAILED DESCRIPTION OF THE INVENTION

Figure 1:
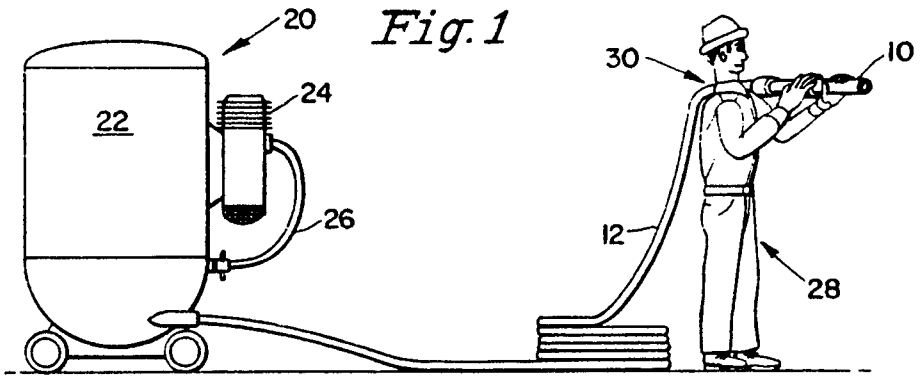
FIG. 1 is a schematic representation of a typical abrasive blast cleaning system and operation thereof.

Referring initially to FIG. 1, a typical air-propelled abrasive blast system includes a blast nozzle 10 that is connected to the outer end of a high pressure flexible supply hose 12 which carries the blast media mixed with air from dispensing device 20 to the inlet of blast nozzle 10. Although not shown, a normally closed "deadman" control valve is mounted adjacent the blast nozzle 10 and functions to prevent operation of the blast nozzle unless the control valve is held open by depressing a spring-loaded lever.

Dispensing device 20 generally includes a supply of abrasive particles, such as sand or, more particularly, sodium bicarbonate, contained in a tank or pot 22 which is sized to hold a selected quantity of abrasive, for example, about 150–250 lbs. Compressed air from compressor 24 is supplied to tank 22 via line 26 and carries the blast media to supply hose 12. The supply hose 12 extends from the tank 22 and typically is passed over the shoulder of the operator designated by reference numeral 28 and is connected to blast nozzle 10. The flow of abrasive blast media from tank 22 through supply hose 12 is typically controlled via a metering and shut-off valve (not shown). When the metering valve is open, a metered flow of abrasive particles is transported by compressed air through supply hose 12 to the blast nozzle 10. There are various means to meter the abrasive blast media into the compressed air stream and any of such metering devices are operable in the present invention. As described above, bends in supply hose 12 formed intermediate tank 22 and blast nozzle 10 and, in particular, bend 30 just prior to the inlet of blast nozzle 10 result in the formation of centrifugal forces which tend to concentrate the abrasive blast media in only a small area of the supply hose opening. This nonuniform flow is maintained throughout the blast nozzle and results in uneven and inadequate productivity.

Figure 2:
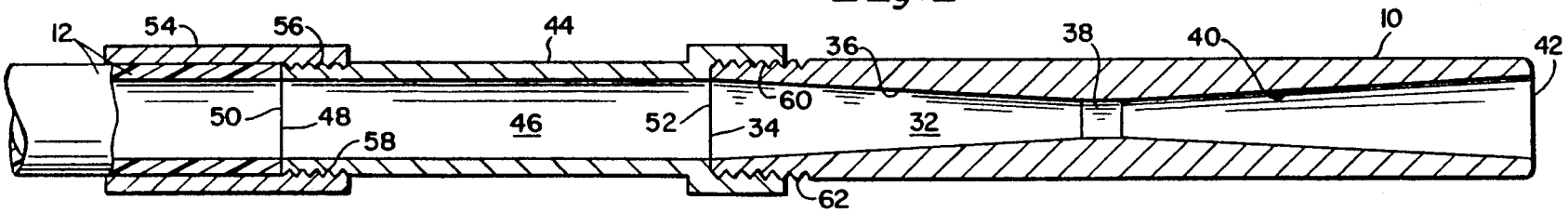
FIG. 2 is a cross-sectional view of the arrangement between the blast nozzle, supply hose and intermediate flow straightener of the present invention.

FIG. 2 illustrates the improved blast nozzle of this invention. As shown therein, the abrasive blast system includes a blast nozzle 10 exemplified by a standard round nozzle containing a bore 32 formed therein defining a longitudinal axis. Bore 32 includes an inlet 34, a converging conical surface 36, a throat 38 and an diverging conical surface 40 which terminates in outlet 42. The venturi effect formed by the juxtaposed conical surfaces 36, 40 and throat 38 serves to accelerate the blast media out of outlet 42 of blast nozzle 10 to an extremely high velocity effective to clean or remove adhered coatings, scale, dirt, grease etc. from the surface being targeted. For protection against the eroding effects of the blast media on the interior surfaces of the blast nozzle, protective inserts or coatings may be advantageously provided on conical surfaces 36 and 40 and within throat area 38. Such coatings or inserts may advantageously comprise ceramics such as tungsten carbide or silicon nitride as erosion resistant materials.

To counteract the effect that centrifugal forces have on concentrating the abrasive blast media to only a small area of the opening in supply hose 12 and consequently to a small area of bore 32 of the blast nozzle 10, there is provided in accordance with the present invention a flow straightener 44 placed intermediate supply hose 12 and blast nozzle 10. Flow straightener 44 contains a continuous longitudinal bore 46 from its inlet end 48 which is contiguous with outlet 50 of the supply hose 12 to outlet 52 which is contiguous with inlet 34 of bore 32 of blast nozzle 10. Bore 46 provides a straight and continuous longitudinal path from supply hose 12 to blast nozzle 10. The intermediate flow straightener 44 is connected to supply hose 12 via a hose coupling or clamp 54 which contains a female threaded portion 56 which cooperatively meshes with male threads 58 adjacent inlet 48 and on the exterior of flow straightener 44. Hose coupling or clamp 54 holds supply hose 12 snugly therein. Flow straightener 44 is connected to blast nozzle 10 via female threads 60 which cooperatively mesh with male threads 62 on the exterior of blast nozzle 10 adjacent inlet 32. It is important that the outer edges of inlet 48 and outlet 52 of flow straightener 44 butt against the edges of outlet 50 of supply hose 12 and inlet 34 of nozzle 10, respectively, such that substantially no gaps are present between the interior of supply hose 12, bore 46 of flow straightener 44 and bore 32 of blast nozzle 10. The presence of gaps may result in the formation of eddy currents in the air stream causing turbulent and uneven blast media flow. In this regard it is not necessary and may actually be disadvantageous to include seals between flow straightener 44 and supply hose 12 and blast nozzle 10 as such seals may be eroded by the blast media resulting in an uneven gap between the sealed surfaces. The exact means by which flow straightener 44 is coupled to the supply hose and the blast nozzle is not overly critical and any type of coupling mechanism can be utilized so long as there is provided the straight flow path from the supply hose to the inlet of the blast nozzle without angular turns and bends which would defeat the purpose of the flow straightener and without substantial gaps between abutting surfaces which may promote turbulent flow.

To effectively counteract the centrifugal forces and again rehomogenize the abrasive blast media within the pressurized air stream and throughout the total area of the supply hose and inlet of the blast nozzle, it is important that the intermediate flow straightener 44 have a sufficient length. Thus, it has been found that the intermediate flow straightener 44 should have a length to diameter ratio (L/D) of at least about 5. L/D ratios of 8 or more are also useful. Typically, the media supply hose and inlet of the blast nozzle have inside diameters of from about 1 to 2 inches. The inside diameter of the flow straightener should have the same diameter as the inlet of the supply hose and inlet of the blast nozzle. Thus, the length of the intermediate flow straightener 44 will be at a minimum of from about 6 inches to 1 foot. The use of L/D ratios substantially smaller than 5 may not result in effective rehomogenization of the blast media in the air stream. On the other hand, flow straighteners with excessively large L/D ratios, e.g., above 16, may be cumbersome and impractical for hand held operation as shown in FIG. 1. The length of the flow straightener may depend upon the type of blast media being utilized. For example, the size of the individual blast media particles and specific density of the media composition will affect the manner in which the media flows through the sharp bend in the blast hose as it traverses the shoulder of the operator and then rehomogenized in the flow straightener. Thus, a heavier blast media may be harder to rehomogenize and require a longer flow straightener. Flow straightener 44 can be formed of any type of material which will resist the abrasive nature of the blast media. It is important further that the intermediate flow straightener 44 be rigid and, thus, not bend between the outlet of the supply hose and the inlet of the blast nozzle. Thus, metals such as stainless steel, ceramics such as those forming the blast nozzle and even rigid plastic or hard rubber materials can be utilized.

In operation, the intermediate flow straightener 44 allows the abrasive blast media particles to be rehomogenized throughout the total air stream and consequently through the total area of bore 46 of flow straightener 44 and bore 32 of blast nozzle 10. Consequently, the blast media particles fill the entire area of outlet 42 and, as such, there is provided an increase in productivity relative to cleaning the targeted surface.

Figure 3:
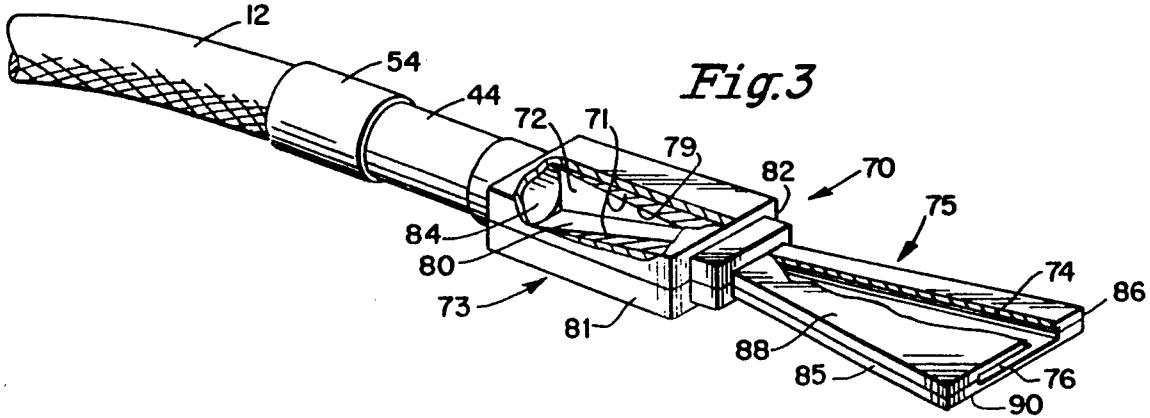
FIG. 3 is a perspective view of an arrangement between an alternative blast nozzle, supply hose and intermediate flow straightener of the present invention with a cut-out section of the fan nozzle alternative.

The usefulness of the intermediate flow straightener 44 can also be found with alternative types of blast nozzles. Thus, in FIG. 3, an alternative blast nozzle 70 which can be characterized as a fan nozzle is shown. Fan nozzle 70 also produces a venturi effect to increase the velocity of the blast media passing therethrough but unlike the standard round nozzle shown as blast nozzle 10 in FIG. 2, convergence and divergence in blast nozzle 70 take place along substantially singular directions which are perpendicular to each other. As shown in FIG. 3, fan nozzle 70 includes a longitudinal passage 72 in rectangular inlet portion 73. Passage 72 is formed by a pair of opposed converging triangular ramps 71 having flat opposing top and bottom surfaces 79 and 80, respectively, converging longitudinally from inlet 84 of passage 72 to a rectangular throat or orifice which is not shown in FIG. 3. Convergence in passage 72 takes place only by means of opposing top and bottom surfaces 79 and 80, respectively, as side surfaces 81 and 82 which also enclose converging passage 72 are substantially parallel and do not converge from inlet 84 to the orifice. Downstream of the orifice is a diverging portion 75 composed of fan-shaped channel 74 and outlet 76. Expansion in channel 74 occurs substantially only between opposed side surfaces 85 and 86. Opposing flat top surface 88 and flat bottom surface 90 do not substantially diverge from each other between the orifice and outlet 76. Accordingly, the direction of convergence between top and bottom surfaces 79 and 80 in converging passage 72 is perpendicular to the direction of divergence between opposing side surfaces 85 and 86 in diverging passage 75.

Fan nozzle 70 has been found to be particularly useful in blasting with lighter and more friable media such as sodium bicarbonate and is more specifically disclosed in copending, commonly assigned application U.S. Ser. No. 979,300, filed Nov. 20, 1992, now U.S. Pat. No. 5,265,383, issued Nov. 30, 1993. The flow straightener is particularly useful with the fan nozzle since the hot spot formed with fan nozzle is more adversely affected by non-uniform or concentrated flow of blast media than the hot spot formed by the round nozzle. Outlet 76 of fan nozzle 70 is generally rectangular and upon expansion of the blast media from the outlet will yield a larger hot spot than the circular outlet of the round nozzle having an equal outlet area due to the greater perimeter to area ratio of the rectangular outlet relative to the circular outlet.

In operation, as in the use of the standard round nozzle, the supply hose 12 and the fan nozzle 70 are connected via the intermediate flow straightener 44 in the same manner as shown in FIG. 2 or as stated previously can be connected in any known manner as long as the flow straightener 44 provides a rigid and straight path for the abrasive blast media to flow from the supply hose to the fan nozzle and has a sufficient L/D ratio as defined previously. All contiguous surfaces should butt together leaving no gaps which could result in the formation of excessive eddies and consequent turbulent flow. This is particularly important when blasting with sodium bicarbonate since turbulent flow can greatly reduce the velocity and cause substantial unwanted decrease in mass of the individual sodium bicarbonate particles. Rehomogenization of the blast media ensures that the media will be uniform through the whole of the fan nozzle outlet 76 to provide optimum productivity. If a lighter blast media is used, such as sodium bicarbonate, the fan nozzle can be formed of stainless steel.

EXAMPLES

Sodium bicarbonate was blasted against a one square foot panel of painted aluminum using a prototype fan nozzle. The supply hose was 1.25 inch in diameter and the fan nozzle had a converging 2 inch long inlet, a 1.5 inch wide orifice with a 0.125 orifice height. The nozzle outlet had a width of 3.375 inches and diverged from the orifice at a 7° angle.

In the first test, sodium bicarbonate was passed through the fan nozzle at a rate of between 14 and 15 lbs per minute. The hot spot on the painted aluminum surface was erratic, containing a light portion and a heavy portion. In view of the non-uniformity of the hot spot, it took approximately 2 to 3 minutes to strip the square foot section of painted aluminum.

In a second test of the fan nozzle, a 12 inch long pipe was attached intermediate of the supply hose and the inlet of the nozzle. The pipe had a diameter of 1.5 inch. Sodium bicarbonate was again passed through the nozzle at a rate of about 14–15 lbs per minute. In this test, the hot spot was substantially even not showing the non-uniformities in the previous test. The painted aluminum panel was stripped in 25–30 seconds.

Blast nozzles containing the flow straightener of the present invention can be used to remove coatings, grease, dirt and the like from any solid surface utilizing a variety of abrasive blast media. Preferably, the blast media will be water soluble in view of the advantages in cleanup as aforementioned. Nonlimiting examples of water soluble media which can be utilized include the alkali metal and alkaline earth metal salts such as the chlorides, carbonates, bicarbonates, sulfates, silicates, etc. The most preferred blast media are the alkali metal bicarbonates as exemplified by sodium bicarbonate. Also useful are sodium sesquicarbonate, natural sodium sesquicarboante known as trona, sodium bicarbonate, sodium carbonate, potassium carbonate, magnesium carbonate, potassium bicarbonate, sodium chloride, sodium sulfate, barium sulfate, etc. It is important to note that by water soluble it is not meant completely water soluble as some salts and natural minerals such as trona may contain minor amount of insoluble materials. For example, trona may contain up to 10 wt. % insolubles.

What is claimed is:

1. An apparatus for removing adherent material from a surface with abrasive particles propelled by air, comprising: a blast nozzle for directing abrasive particles to a surface, said blast nozzle having an inlet for receiving a stream of compressed air and entrained abrasive particles and a substantially rectangular outlet for directing said particles to said surface, said blast nozzle containing an inlet passage communicating with said inlet and being formed from a pair of opposing flat top and bottom surfaces which converge from said inlet to an orifice and a pair of opposing substantially flat side surfaces, said inlet passage converging substantially only by means of said pair of opposing flat top and bottom surfaces to said orifice, said blast nozzle further comprising an outlet passage from said orifice to said outlet, said outlet passage being formed from a pair of opposing side surfaces which diverge from said orifice to said outlet and a pair of opposed substantially flat top and bottom surfaces, said outlet passage diverging substantially only by means of said pair of opposing side surfaces, said apparatus further comprising a flow straightening means to homogenize the abrasive particles within the compressed air stream and placed contiguous with and upstream of said inlet of said blast nozzle, said flow straightening means having a longitudinal bore therethrough, said bore having a circular cross-section and a length to diameter ratio of at least about 5, said bore, said blast nozzle inlet, said inlet passage, and said outlet passage defining a substantially straight flow path.

2. The apparatus of claim 1 wherein said bore of said flow straightening means has a length to diameter ratio of at least about 8.

3. The apparatus of claim 1 further including a flexible supply hose to direct abrasive and compressed air to said inlet of said blast nozzle, said flow straightening means being placed intermediate said supply hose and said blast nozzle inlet.

4. The apparatus of claim 3 wherein said supply hose has a circular cross-section, said flow straightening means including a circular inlet which is contiguous with and has an inside diameter which is substantially equivalent to the inside diameter of said supply hose and an outlet which is contiguous with said inlet of said blast nozzle.

5. The apparatus of claim 4 wherein said inlet and outlet of said flow straightening means abut said supply hose and said inlet of said blast nozzle, respectively, whereby no gaps are present between said supply hose, said flow straightening means and said inlet of said blast nozzle.

6. The apparatus of claim 4 wherein said flexible supply hose has an inside diameter of from about 1 to 2 inches.

7. The apparatus of claim 1 wherein said flow straightening means is threaded onto said blast nozzle.

8. The apparatus of claim 3 wherein said apparatus further includes a means to mix said abrasive particles with said compressed air stream and direct said mix to said flexible supply hose.

9. The apparatus of claim 8 further combined with a supply of abrasive particles, said supply communicating with said means to mix said abrasive with said compressed air stream.

10. The apparatus of claim 9 wherein said abrasive particles are water soluble.

11. The apparatus of claim 10 wherein said abrasive particles comprise sodium bicarbonate.

* * * * *